US010010905B1

(12) United States Patent
Kelly

(10) Patent No.: US 10,010,905 B1
(45) Date of Patent: Jul. 3, 2018

(54) POLE-PAINTING TOOL

(71) Applicant: Lance P Kelly, Granbury, TX (US)

(72) Inventor: Lance P Kelly, Granbury, TX (US)

( * ) Notice: Subject to any disclaimer, the term of this patent is extended or adjusted under 35 U.S.C. 154(b) by 0 days.

(21) Appl. No.: 15/358,764

(22) Filed: Nov. 22, 2016

Related U.S. Application Data

(60) Provisional application No. 62/259,202, filed on Nov. 24, 2015.

(51) Int. Cl.
*B05C 17/02* (2006.01)

(52) U.S. Cl.
CPC ..... *B05C 17/0227* (2013.01); *B05C 17/0205* (2013.01)

(58) Field of Classification Search
CPC . B05C 17/02; B05C 17/0232; B05C 17/0227; B05C 17/0215; B05C 17/0205
See application file for complete search history.

(56) References Cited

U.S. PATENT DOCUMENTS 2,805,439 A * 9/1957 Parker ..... B05C 17/0227 15/230.11
6,505,374 B1 * 1/2003 Weihrauch ..... B05C 17/02 15/230.11
2013/0029811 A1 * 1/2013 Lando ..... A63B 21/023 482/121

* cited by examiner

*Primary Examiner* — Shay Karls
(74) *Attorney, Agent, or Firm* — Kenneth L Tolar

(57) ABSTRACT

A pole-painting tool includes a V-shaped handle having an apex that is encapsulated by a foam handgrip, and two free ends with a roller assembly removably mounted therebetween. The roller assembly includes an axle having a plurality of narrow, juxtaposed paint rollers mounted thereon. Accordingly, the rollers are submerged within a paint supply and placed against a pole, a pipe or another tubular object. By applying a directional force to the handgrip, a worker can conform the rollers around the tubular surface to more efficiently apply paint thereto.

10 Claims, 2 Drawing Sheets

POLE-PAINTING TOOL

CROSS REFERENCE TO RELATED APPLICATIONS

This application is entitled to the benefit of provisional patent application No. 62/259,202 filed on Nov. 24, 2015, the specification of which is incorporated herein by reference.

BACKGROUND OF THE INVENTION

The present invention relates to a tool that allows a user to easily apply paint to a pole, a pipe or another tubular surface.

DESCRIPTION OF THE PRIOR ART

Painting a tubular surface is tedious and time consuming. Using a brush is extremely inefficient and requires numerous, repeated brush strokes to coat a given surface area. A roller is equally inefficient due to its rigidity and inability to conform to arcuate surfaces.

Accordingly, there is currently a need for a device that allows a worker to more efficiently paint a tubular surface. The present invention addresses this need by providing a tool formed of multiple, juxtaposed rollers mounted on a pliable axle that will collectively conform to a tubular surface when a force is applied to a handle.

SUMMARY OF THE INVENTION

The present invention relates to a pole-painting tool comprising a V-shaped handle having an apex that is encapsulated by a foam handgrip, and two free ends with a roller assembly removably mounted therebetween. The roller assembly includes a pliable axle having a plurality of narrow, juxtaposed paint rollers mounted thereon. Accordingly, the rollers are submerged within a paint supply and placed against a pole, pipe or another tubular object. By applying a directional force to the handgrip, a worker can conform the rollers around the tubular surface to more efficiently apply paint thereto.

It is therefore an object of the present invention to provide a tool that allows a user to efficiently apply paint to a tubular surface.

It is therefore another object of the present invention to provide a pole-painting tool having a roller assembly that can easily be removed and replaced.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
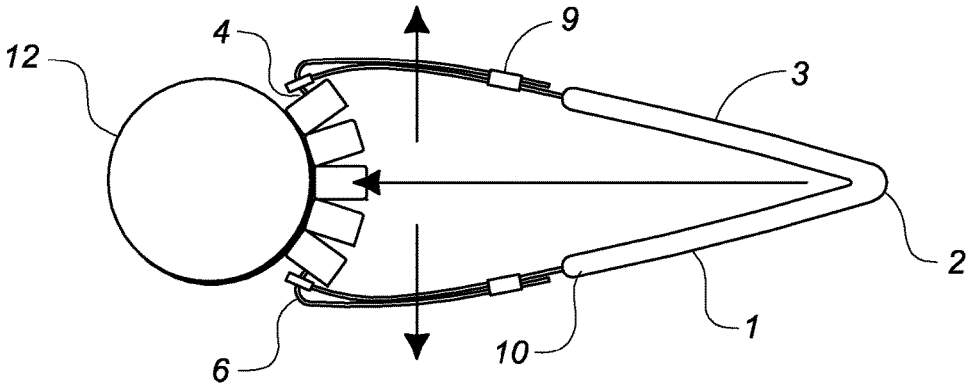
FIG. 1 is a plan view of the tool according to present invention with the rollers placed against a pole.
Figure 2:
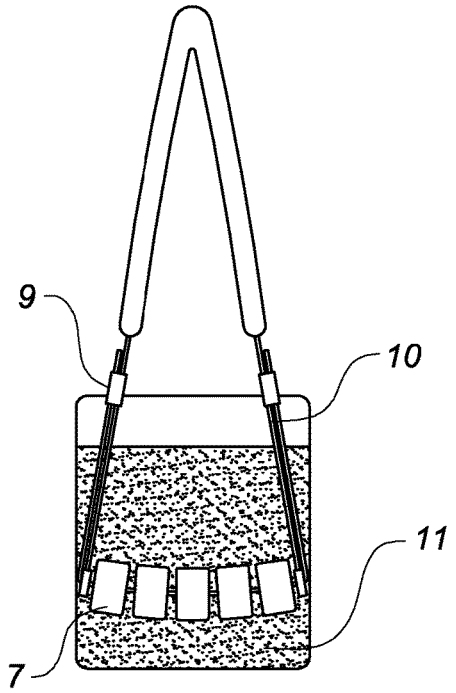
FIG. 2 depicts the rollers being submerged in a paint supply.
Figure 3:
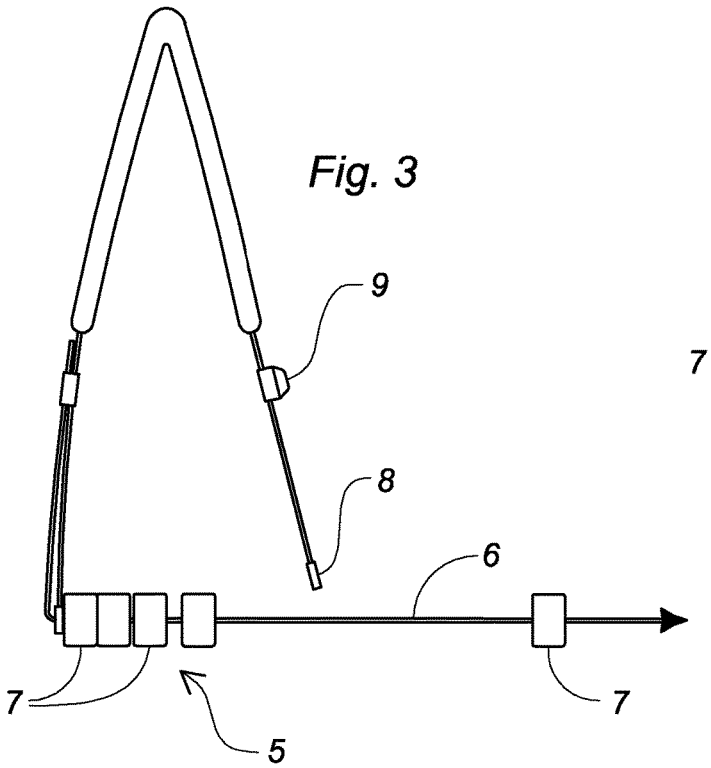
FIG. 3 depicts the method of replacing the rollers.
Figure 4:
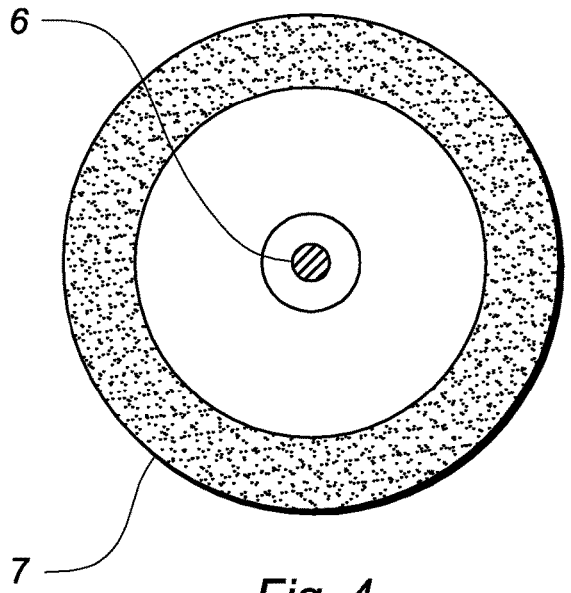
FIG. 4 is an isolated end view of an exemplary roller.
Figure 5:
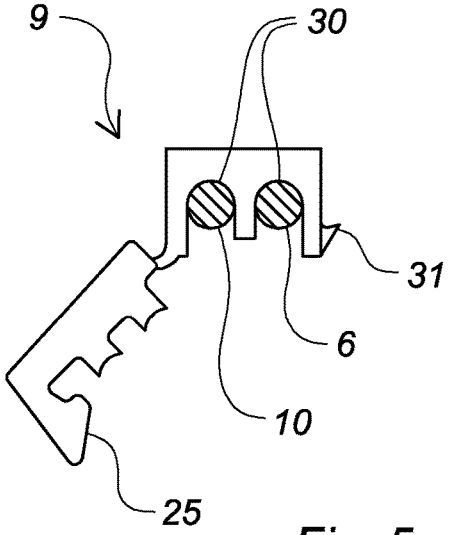
FIG. 5 is an isolated view of the roller clip.
Figure 6:
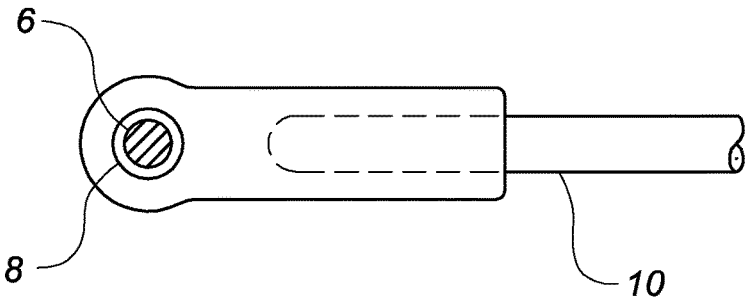
FIG. 6 is an isolated, cutaway view of a side rail and attached eyelet.

The present invention relates to a pole-painting tool comprising a V-shaped handle 1 having an apex 2 with a pair of diverging side rails 10 extending therefrom, each of the side rails terminating at a free end 4. The apex and a portion of the side rails 10 are encapsulated by a foam handgrip 3. Removably secured between the two free ends 4 is a roller assembly 5.

The roller assembly includes an axle 6 constructed with nylon rope or a similar pliable material having a plurality of narrow, juxtaposed paint rollers 7 slidably mounted thereon. The axle passes through an eyelet 8 at each of the free ends of the side rails and extends along a predetermined length thereof. The axle is secured with a releasable clip 9 having a pair of passageways 30 that each receive either a side rail or the axle. A lever 25 gripping a latch 31 is pivoted to release the axle from the handle to allow a user to remove, replace or add a roller.

Accordingly, the rollers are submerged within a paint supply 11 and placed against a pole, a pipe or another tubular object 12. By applying a directional force to the handgrip, a worker can conform the rollers around the tubular surface to more efficiently apply paint thereto.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A pole-painting tool comprising:

a V-shaped handle having an apex with a pair of diverging side rails, each of said side rails terminating at a free end;

a pliable axle removably mounted between each of said side rails, wherein said axle is secured to each side rail with a releasable clip, said clip having a pair of passageways for receiving a side rail and the axle, said axle further passing through an eyelet at each free end of said side rails and extending along a predetermined length of the side rails;

a plurality of narrow rollers slidably mounted on said axle whereby applying a directional force to said handle causes the axle to bend and the rollers to conform around a tubular surface to more efficiently apply paint thereto.

2. The pole-painting tool according to claim 1 wherein said apex and a portion of said side rails are encapsulated with a foam handgrip.

3. The pole-painting tool according to claim 1 wherein said clip includes a release lever gripping a latch that is pivoted to release the axle from the handle to allow a user to remove, replace or add a roller.

4. The pole-painting tool according to claim 1 wherein said axle is constructed with nylon rope.

5. A pole-painting tool comprising:

a V-shaped handle having an apex with a pair of diverging side rails, each of said side rails terminating at a free end;

a pliable axle mounted between each of said side rails, wherein said axle is constructed with nylon rope;

a plurality of narrow rollers slidably mounted on said axle whereby applying a directional force to said handle causes the axle to bend and the rollers to conform around a tubular surface to more efficiently apply paint thereto.

6. The pole-painting tool according to claim 5 wherein said axle is removably attached to said handle to allow said rollers to be removed and replaced.

7. The pole-painting tool according to claim 5 wherein said apex and a portion of said side rails are encapsulated with a foam handgrip.

8. The pole-painting tool according to claim 5 wherein said axle passes through an eyelet at each free end of said side rails and extends along a predetermined length of the side rails.

9. The pole-painting tool according to claim 5 wherein said axle is secured to each side rail with a releasable clip, said clip having a pair of passageways for receiving a side rail and the axle.

10. The pole-painting tool according to claim 9 wherein said clip includes a release lever gripping a latch that is pivoted to release the axle from the handle to allow a user to remove, replace or add a roller.

* * * * *